US005398428A

United States Patent [19]

Wallace

[11] Patent Number: 5,398,428

[45] Date of Patent: Mar. 21, 1995

[54] SHOE DRYER BRACKET

[76] Inventor: Earl Wallace, 56 Tudor La., Bayshore, N.Y. 11706

[21] Appl. No.: 231,652

[22] Filed: Apr. 25, 1994

[51] Int. Cl.[6] ..... F26B 11/02

[52] U.S. Cl. ..... 34/600; 34/104; 248/205.1

[58] Field of Search ..... 34/600, 595, 599, 602, 34/604, 104, 440, 239, 240; 248/205.1

[56] References Cited

U.S. PATENT DOCUMENTS

| | | | |
|---|---|---|---|
| 4,467,535 | 8/1984 | Hardison | 34/600 |
| 4,617,743 | 10/1986 | Barnard | 34/600 |
| 4,677,760 | 7/1987 | St. Louis | 34/103 |
| 4,813,641 | 3/1989 | Wilson | 34/600 |
| 5,080,312 | 1/1992 | Ebey | 248/316.4 |
| 5,220,734 | 6/1993 | Carver | 34/600 |
| 5,276,979 | 1/1994 | Gordon, Sr. | 34/600 |
| 5,333,393 | 8/1994 | Hill et al. | 34/440 |

*Primary Examiner*—Denise L. Gromada
*Attorney, Agent, or Firm*—E. Michael Combs

[57] ABSTRACT

First and second telescoping support tubes are arranged for securement relative to one another in an extended orientation and provided with respective first and second rigid foot members, wherein the foot members are arranged to be received within respective shoes to be imposed to the interior surface of a conventional rotary drying machine.

3 Claims, 4 Drawing Sheets

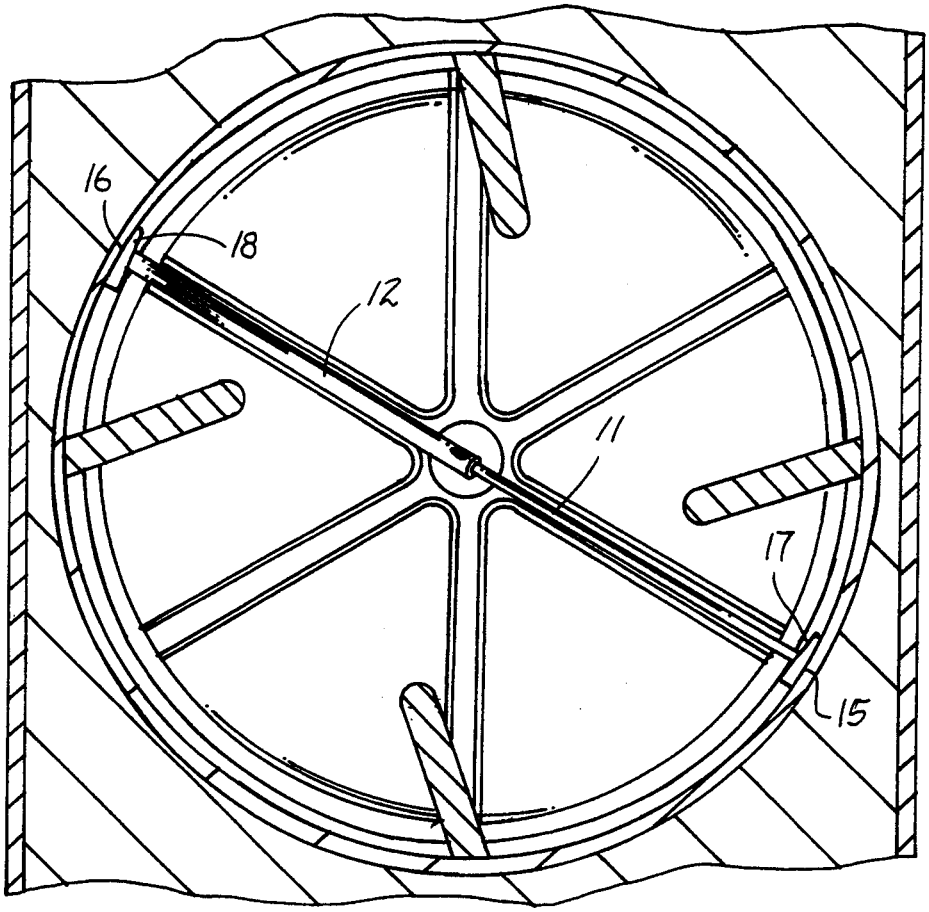
FIG. 3
FIG. 4
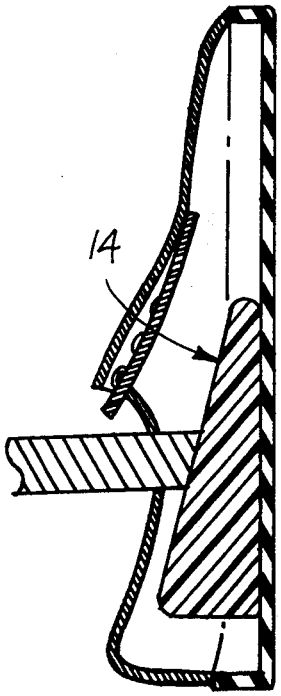

SHOE DRYER BRACKET

BACKGROUND OF THE INVENTION

1. Field of the Invention

The field of invention relates to shoe drying apparatus, and more particularly pertains to a new and improved shoe dryer bracket wherein the same is arranged for the positioning and mounting of shoes within a rotary tumbling dryer apparatus.

2. Description of the Prior Art

A shoe drying rack is indicated in U.S. Pat. No. 4,109,397 for positioning within a drying machine, as well as U.S. Pat. No. 5,080,312.

The instant invention attempts to overcome deficiencies of the prior art by providing for a bracket structure arranged for accommodating various thicknesses of shoe soles and dryer drums and in this respect, the present invention substantially fulfills this need.

SUMMARY OF THE INVENTION

In view of the foregoing disadvantages inherent in the known types of shoe drying apparatus now present in the prior art, the present invention provides a shoe dryer bracket wherein the same is arranged for ease of mounting and positioning of a shoe pair within a rotary dryer drum. As such, the general purpose of the present invention, which will be described subsequently in greater detail, is to provide a new and improved shoe dryer bracket which has all the advantages of the prior art shoe drying apparatus and none of the disadvantages.

To attain this, the present invention provides first and second telescoping support tubes arranged for securement relative to one another in an extended orientation and provided with respective first and second rigid foot members, wherein the foot members are arranged to be received within respective shoes to be imposed to the interior surface of a conventional rotary drying machine.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shoe dryer bracket which has all the advantages of the prior art shoe dryer apparatus and none of the disadvantages.

It is another object of the present invention to provide a new and improved shoe dryer bracket which may be easily and efficiently manufactured and marketed.

It is a further object of the present invention to provide a new and improved shoe dryer bracket which is of a durable and reliable construction.

An even further object of the present invention is to provide a new and improved shoe dryer bracket which is susceptible of a low cost of manufacture with regard to both materials and labor, and which accordingly is then susceptible of low prices of sale to the consuming public, thereby making such shoe dryer brackets economically available to the buying public.

Still yet another object of the present invention is to provide a new and improved shoe dryer bracket which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 3—3 of FIG. 1 in the direction indicated by the arrows.

FIG. 4 is an orthographic view, taken along the lines 4—4 of FIG. 1 in the direction indicated by the arrows.

DESCRIPTION OF THE PREFERRED EMBODIMENT

Figure 1:
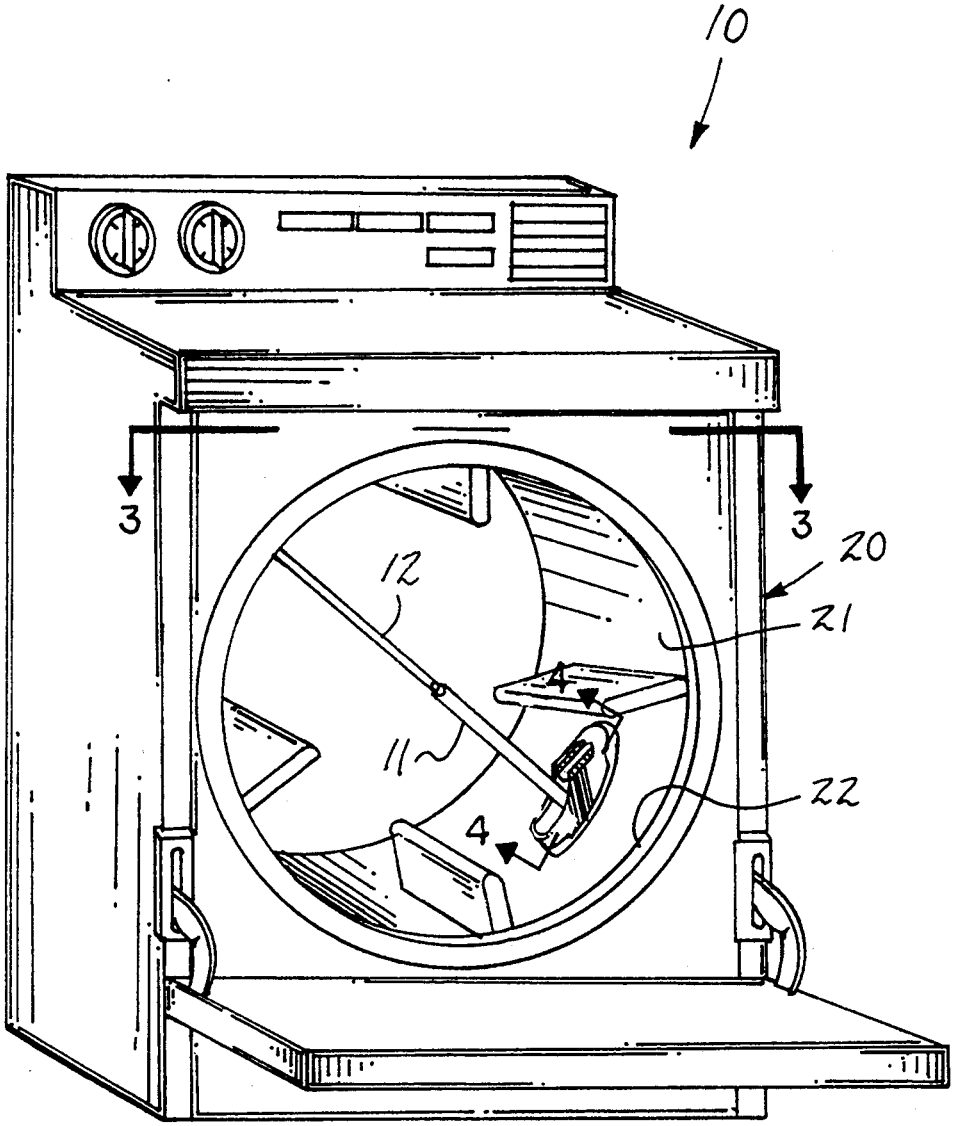
FIG. 1 is an isometric illustration of the invention.
Figure 2:
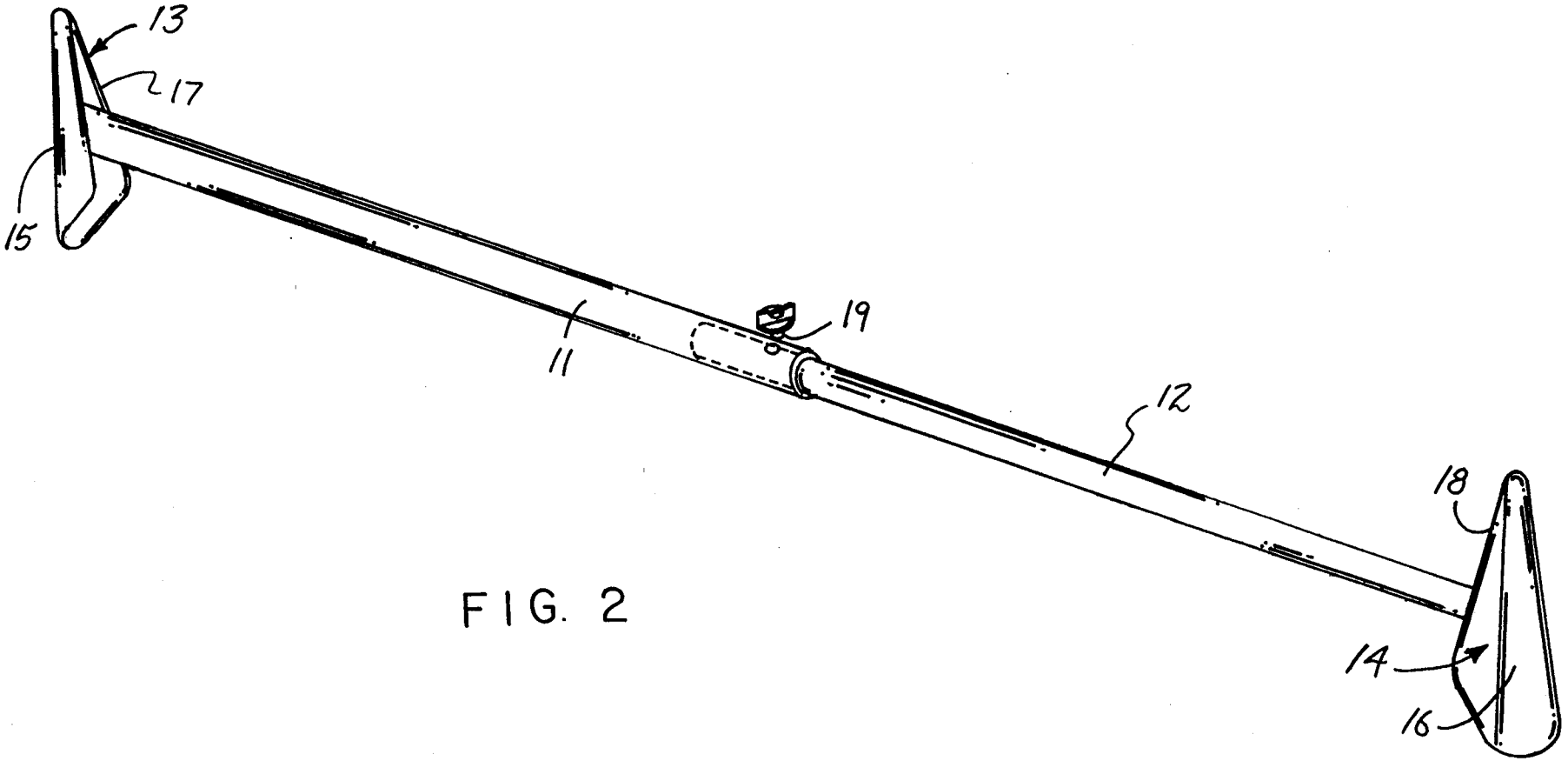
FIG. 2 is an isometric illustration of the dryer bracket structure.
Figure 5:
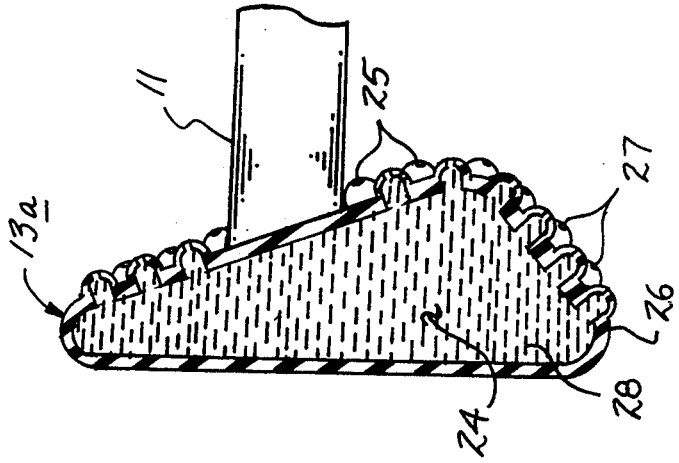
FIG. 5 is a cross-sectional illustration of a modified bracket foot structure.

With reference now to the drawings, and in particular to FIGS. 1 to 6 thereof, a new and improved shoe dryer bracket embodying the principles and concepts of the present invention and generally designated by the reference numeral 10 will be described.

More specifically, the shoe dryer bracket 10 of the instant invention essentially comprises (see FIG. 2) first and second support tubes 11 and 12 respectively arranged for coaxial telescoping engagement relative to one another, such that a first rigid polymeric foot 13 is fixedly mounted to a free distal end of the first support tube 11 and a second rigid polymeric foot 14 is mounted to a free end of the second support tube 12. The first foot 13 having a first foot floor 15 orthogonally oriented relative to the first tube 11, with the second foot 14 having a second foot floor 16 orthogonally mounted to the second tube 12. The first foot includes a first foot top wall 17 that is arranged in a canted relationship relative to the first support tube, and the second foot having a second foot top wall 18 canted relative to the second tube 12 arranged for inter-fitting within respective shoes, in a manner as indicated in FIG. 1 for example, within a conventional rotary drying machine 20 having a rotary drum 21, such that the bracket structure is positioned through the drum entrance opening 22 and extended relative to one another. When the opposed shoes are in contiguous diametrically opposed engagement within the rotary drum 21, a fastener 19 threadedly directed through the first support tube 11 is arranged to engage the second support tube 12 to maintain the first and second tubes in the extended orientation, such as indicated in FIG. 1 and FIG. 3.

Figure 6:
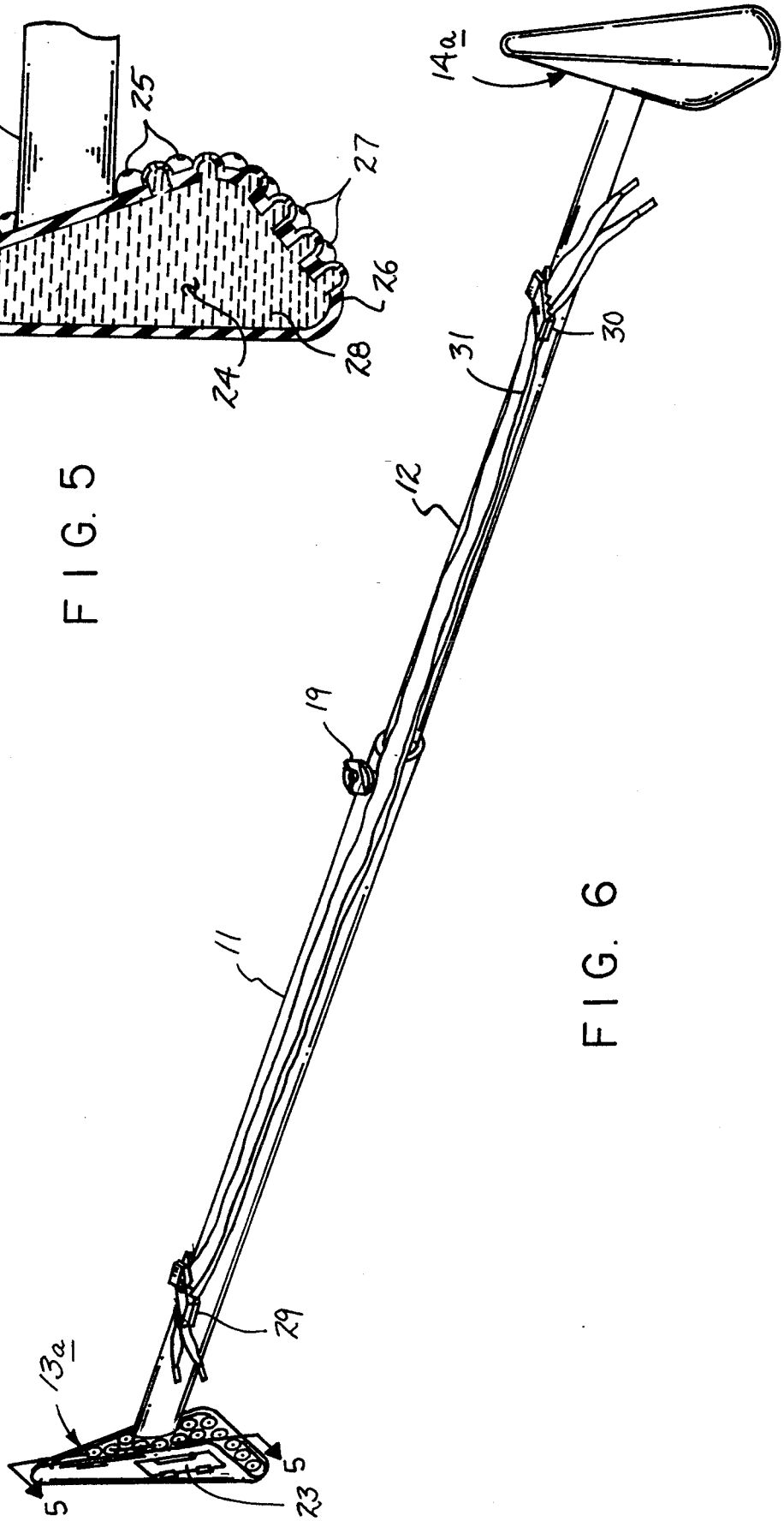
FIG. 6 is an isometric illustration of a modified bracket structure.

The FIG. 6 includes modified first and second rigid polymeric feet 13 and 14 respectively, such that each of the modified feet include a foot cavity 24 (see FIG. 5), as well as a plurality of foot top wall apertures 25, with each foot having a foot front wall 26 having a plurality of front wall apertures 27. The foot cavity 24 is accessed through a door plate 23 (see FIG. 6) permitting the filling of the cavity 24 with a scented fluid 28 or with various characteristics such as bactericides, germicides, and the like. In this manner, during the rotary action of the drum 21, the fluid is expelled through the various apertures 25 and 27 within an individual shoe member. Further, the structure as indicated includes a first clamp jaw pair 29 mounted upon the first support tube 11, with a second clamp jaw pair 30 mounted upon the second support tube 12, such that the shoe laces 31 may be secured between the first and second clamp jaw pairs 29 and 30 for enhanced drying of the shoe laces during a drying procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A shoe dryer bracket, comprising, an elongate first support tube and an elongate second support tube coaxially aligned relative to the first support tube, with the second support tube telescopingly received within the first support tube, and a fastener member directed through the first support tube in an engaging relationship relative to the second support tube permitting selective securement of the first support tube and the second support tube relative to one another, the first support tube having a first support tube outer end, the second support tube having a second support tube outer end, with the first support tube outer end having fixedly thereto a first rigid foot, and the second support tube outer end having secured thereto a second rigid outer foot, and the first foot includes a first foot floor obliquely oriented relative to the first support tube, with the second foot having a second foot floor obliquely oriented relative to the second support tube, the first foot having a first foot top wall intersected by the first support tube, and the second foot having a second foot top wall intersected by the second support tube, at least said first foot having a first foot cavity oriented within said first foot, and said first foot cavity arranged to receive a fluid therein with said first foot top wall having delivery means for permitting delivery of said fluid through said top wall.

2. A bracket as set forth in claim 1 wherein the deliver means comprises the first foot top wall having a plurality of top wall apertures, and the first foot having a first foot front wall extending between the first foot floor and the first foot top wall, with the front wall having a plurality of front wall apertures, with the top wall apertures and the front wall apertures in communication with said cavity.

3. A bracket as set forth in claim 2 wherein the first support tube includes a first clamp jaw pair, and the second support tube includes a second clamp jaw pair, wherein shoe laces are arranged for securement between the first clamp pair and the second clamp jaw pair.

* * * * *